US009108838B2

(12) United States Patent
Strauss

(10) Patent No.: US 9,108,838 B2
(45) Date of Patent: Aug. 18, 2015

(54) COMPOSITE PAD FOR SADDLE PANEL

(71) Applicant: Isidore N. Strauss, Bridgewater, NJ (US)

(72) Inventor: Isidore N. Strauss, Bridgewater, NJ (US)

(73) Assignee: Intec Corporation, Cliffwood, NJ (US)

( * ) Notice: Subject to any disclaimer, the term of this patent is extended or adjusted under 35 U.S.C. 154(b) by 44 days.

(21) Appl. No.: 13/777,101

(22) Filed: Feb. 26, 2013

(65) Prior Publication Data

US 2014/0237953 A1 Aug. 28, 2014

(51) Int. Cl.
*B68C 1/12* (2006.01)
*B68C 1/02* (2006.01)

(52) U.S. Cl.
CPC . *B68C 1/126* (2013.01); *B68C 1/02* (2013.01); *B68C 1/12* (2013.01)

(58) Field of Classification Search
CPC ..... B68C 1/12; B68C 1/02; B68C 1/126
USPC ..... 54/66, 65, 44.5
IPC ..... B68C 1/02, 1/12
See application file for complete search history.

(56) References Cited

U.S. PATENT DOCUMENTS

| | | | | | |
|---|---|---|---|---|---|
| 302,575 | A | * | 7/1884 | Maclachlan | 54/66 |
| 402,480 | A | * | 4/1889 | Robbins | 54/66 |
| 420,222 | A | * | 1/1890 | Bates | 54/66 |
| 1,824,488 | A | * | 9/1931 | Kopf | 54/66 |
| 2,883,316 | A | * | 4/1959 | Leahy et al. | 428/339 |
| 3,872,653 | A | * | 3/1975 | Thompson | 54/44.5 |
| 3,971,194 | A | | 7/1976 | Morgan | |
| 4,136,506 | A | | 1/1979 | Miller | |
| 4,190,697 | A | * | 2/1980 | Ahrens | 428/309.9 |
| 4,974,397 | A | | 12/1990 | Ricken | |
| 5,018,341 | A | * | 5/1991 | Evertson | 54/66 |
| 5,175,986 | A | | 1/1993 | Farley | |
| 5,299,412 | A | | 4/1994 | Cudney et al. | |
| 5,456,072 | A | * | 10/1995 | Stern | 54/44.5 |
| 5,575,139 | A | | 11/1996 | Green | |
| 5,802,823 | A | | 9/1998 | Woods | |
| 6,035,616 | A | * | 3/2000 | Pickett | 54/44.5 |
| 6,044,630 | A | | 4/2000 | Coffin | |
| 6,421,989 | B1 | | 7/2002 | Leson | |
| 6,474,052 | B2 | * | 11/2002 | Kempsell et al. | 54/44.6 |
| 6,574,947 | B2 | | 6/2003 | Landi et al. | |
| 6,688,087 | B2 | | 2/2004 | DeCosemo | |
| 7,168,225 | B2 | | 1/2007 | Mattes et al. | |
| 7,219,486 | B1 | | 5/2007 | Conforth | |
| 7,231,889 | B2 | | 6/2007 | Coffin | |
| 7,487,628 | B2 | | 2/2009 | Foster et al. | |
| 7,562,514 | B2 | | 7/2009 | Bates et al. | |
| 2002/0078666 | A1 | * | 6/2002 | Bates | 54/44.1 |
| 2002/0162307 | A1 | | 11/2002 | Arnold | |
| 2004/0048535 | A1 | | 3/2004 | Sacks | |
| 2004/0216433 | A1 | | 11/2004 | Coffin | |
| 2007/0051077 | A1 | | 3/2007 | Fennelly | |
| 2013/0081365 | A1 | * | 4/2013 | Ruiz Daiz | 54/44.5 |

* cited by examiner

*Primary Examiner* — Kathleen Alker
(74) *Attorney, Agent, or Firm* — King & Schickli PLLC

(57) ABSTRACT

A composite pad for a saddle panel includes a first panel having a first firmness property and a second panel having a second firmness property that is different from the first panel firmness property. The first and second panels are configured whereby the first panel substantially nests in a cavity defined in the second panel. The second panel firmness is typically less than the first panel firmness, whereby in use the assembled composite pad the softer second panel will contact the back of an animal wearing the saddle. Saddle panels and saddles incorporating the composite pad of the disclosure are described.

4 Claims, 6 Drawing Sheets

COMPOSITE PAD FOR SADDLE PANEL

TECHNICAL FIELD

The present disclosure relates to saddles used in equitation. More particularly, the disclosure relates to a composite pad for use in a saddle panel, providing differing degrees of firmness for the panel.

BACKGROUND OF THE INVENTION

Modern equestrian saddles 10 possess various common elements (see FIG. 1), including a seat 12 on which a rider sits, a pommel 14, a cantle 16, side flaps 18, and a saddle panel 20. The saddle panel is an important part of saddle making and saddle fitting, providing a cushioning layer between the saddle seat and the back of the horse which will be wearing the saddle. In its simplest form, a saddle panel is simply a sleeve or cavity of leather or other saddle-making material filled with a cushioning substance, underlying a bottom surface of the saddle seat to contact and cushion the horse's back and provide a comfortable fit. An improperly fitted or insufficiently cushioned saddle and saddle panel may result in discomfort and potentially injury to the horse's back.

Typically, the saddle panel comprises two adjoining pads, separated by an intervening channel which provides airflow and a space to accommodate a horse's spine. A variety of saddle panel configurations are known in the art. For example, a dropped or trapezius panel provides panels that are deeper in the area below and to the rear of the horse's wither, to accommodate horses that have dips behind and to the rear of the wither. A "K" panel is deeper under the frontal portion of the saddle, to accommodate horses that have a high, "shark fin" wither. An upswept panel, as the name suggests, has a rear portion that is upswept rather than squared off, for horses with short backs. Saddle panels may be gusseted, including a wedge-shaped piece disposed at a rear of the saddle to broaden and flatten the weight bearing area in the rear portion of the panel, or non-gusseted. Saddle panels may further be unitary, or may comprise two independent separate panels spaced apart on the saddle underside to so define the channel.

Likewise, a number of different materials are used in constructing saddle panels. A flocked panel is a panel as described above, i.e. one or more sleeves filled with wool or a synthetic fiber. These panels are often the softest of saddle panel types, breaking in (adjusting their shape to conform to the horse's back) quite quickly. Likewise, the cushioning of the flocked panel is easily altered or adjusted, requiring only adding, shifting, or removing wool or synthetic fiber from the panel. A so-called "Swiss panel" is of similar construction, comprising wool or synthetic fiber encased in felt or other fabric. The Swiss panel can likewise be adjusted as to firmness by flocking, although to a lesser degree than a conventional flocked panel that is not encased in felt. A "French panel" comprises a foam encased in felt or other fabric. This type of panel can only be adjusted as to fit and firmness by adding or removing separate pads and/or shims. A foam panel likewise comprises a foam, and can only be adjusted as to firmness with separate shims or pads.

Conventional saddle panels, regardless of their configuration, suffer from a disadvantage in that only a single degree of firmness is possible. That is, in conventional panels, the degree of firmness of the saddle panel is determined by the material used. Providing a variable degree of firmness of the panel is not possible. The density of a foam will determine its weight and durability, i.e. how long the foam will last and retain its shape. However, the firmness of a foam, often empirically measured as Indentation Load Deflection (ILD) (that is, the pounds of force required to compress a thickness of a segment of the foam by 25%), is substantially independent of foam density. So, saddle manufacturers previously were required to balance the need for saddle cushioning and weight with the need for a saddle panel that would last a commercially suitable length of time, retaining its shape and cushioning properties in a manner and for a length of time satisfactory to the consumer.

For this reason, there remains a need in the art for improvements in the design of saddles and saddle panels therefore, providing the desired functions of cushioning function, and durability

SUMMARY OF THE INVENTION

The above-mentioned and other problems become solved by applying the principles and teachings associated with the hereinafter-described saddle panel and composite pads for a saddle panel. In embodiments, the saddle panel includes a first panel having a first firmness property, and a second panel having a second firmness property that is different from the first firmness property. The relative firmness properties may be measured as Indentation Load Deflection (ILD) as is known in the art.

Typically, the first and second panels are configured such that the first panel substantially nests in a cavity defined in the second panel. In embodiments, the second panel firmness is less than the first panel firmness. The first and second panels may be secured one to the other, such as by a conventional adhesive, and wrapped in a layer of conventional saddle-making material such as leather or a synthetic. Optionally, a breathable layer of material may be interposed between at least a portion of the first and second panels to define a channel through which moisture, vapor, air, etc. but not particulate debris may pass. The first and second panels may be configured such that a unitary saddle panel is defined, or may be configured to provide independent panels of a saddle pad which may be spaced apart on the saddle underside to define an intervening channel during saddle manufacture as described above.

In use such as on a saddle for equitation, the panels may be configured such that during use of the saddle in equitation, the second panel is disposed below the first panel whereby the second, softer panel contacts the horse's back. As will be appreciated, this improves comfort and reduces risk of injury to the animal. However, the firmer panel which is disposed closest to the saddle seat and the rider, provides a firmer surface for the rider, improving rider "feel" and "contact" with the saddle during use.

These and other embodiments, aspects, advantages, and features of the present invention will be set forth in the description which follows, and in part will become apparent to those of ordinary skill in the art by reference to the following description of the invention and referenced drawings or by practice of the invention. The aspects, advantages, and features of the invention are realized and attained by means of the instrumentalities, procedures, and combinations particularly pointed out in the appended claims.

BRIEF DESCRIPTION OF THE DRAWINGS

The accompanying drawings incorporated in and forming a part of the specification, illustrate several aspects of the present invention, and together with the description serve to explain the principles of the invention. In the drawings.

DETAILED DESCRIPTION OF THE INVENTION

The above-mentioned and other problems become solved by applying the principles and teachings associated with the description that follows. In the following detailed description of the illustrated embodiments, reference is made to the accompanying drawings that form a part hereof, and in which is shown by way of illustration, specific embodiments in which the invention may be practiced. These embodiments are described in sufficient detail to enable those skilled in the art to practice the invention and like numerals represent like details in the various figures. Also, it is to be understood that other embodiments may be utilized and that process, mechanical, arrangement, and/or other changes may be made without departing from the scope of the present invention. Broadly, the present disclosure provides a composite pad for a saddle panel, and saddles manufactured therewith.

Figure 1:
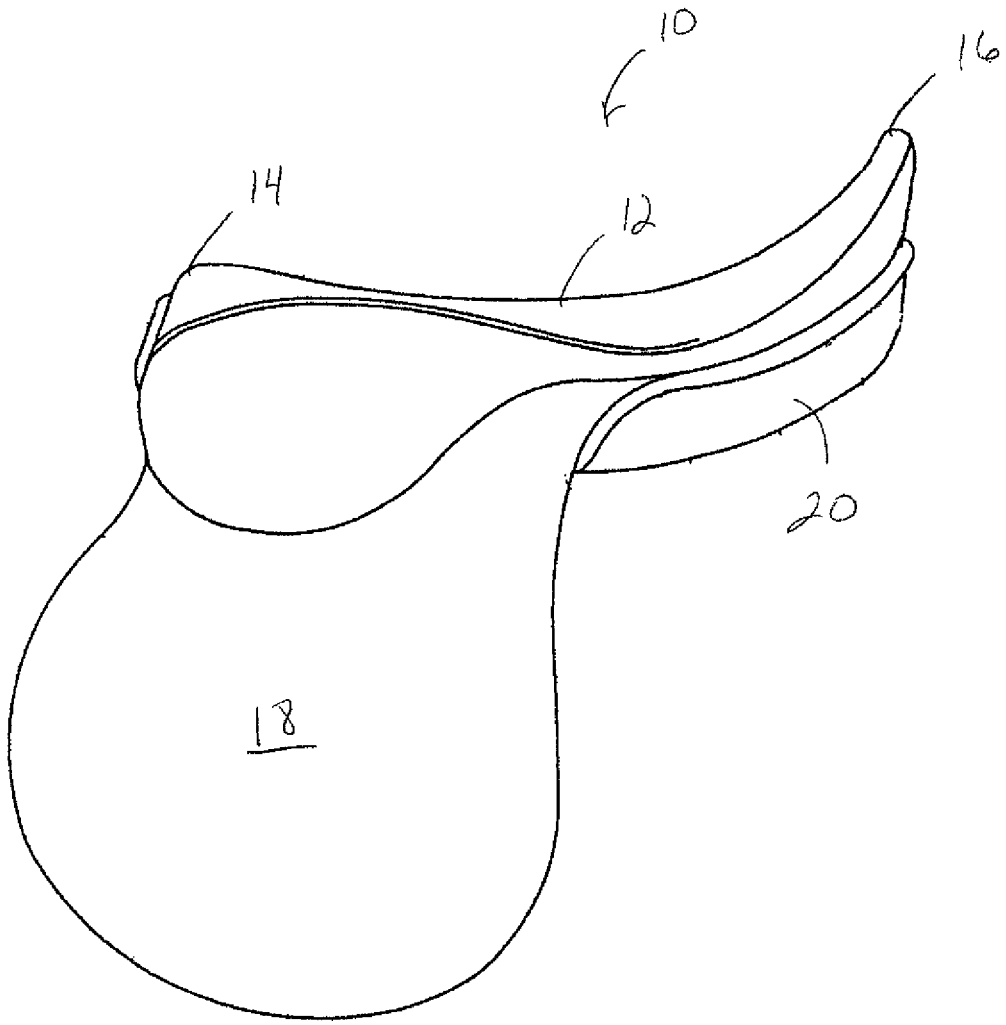
FIG. 1 Prior Art
FIG. 1 depicts a conventional English style saddle.
Figure 2:
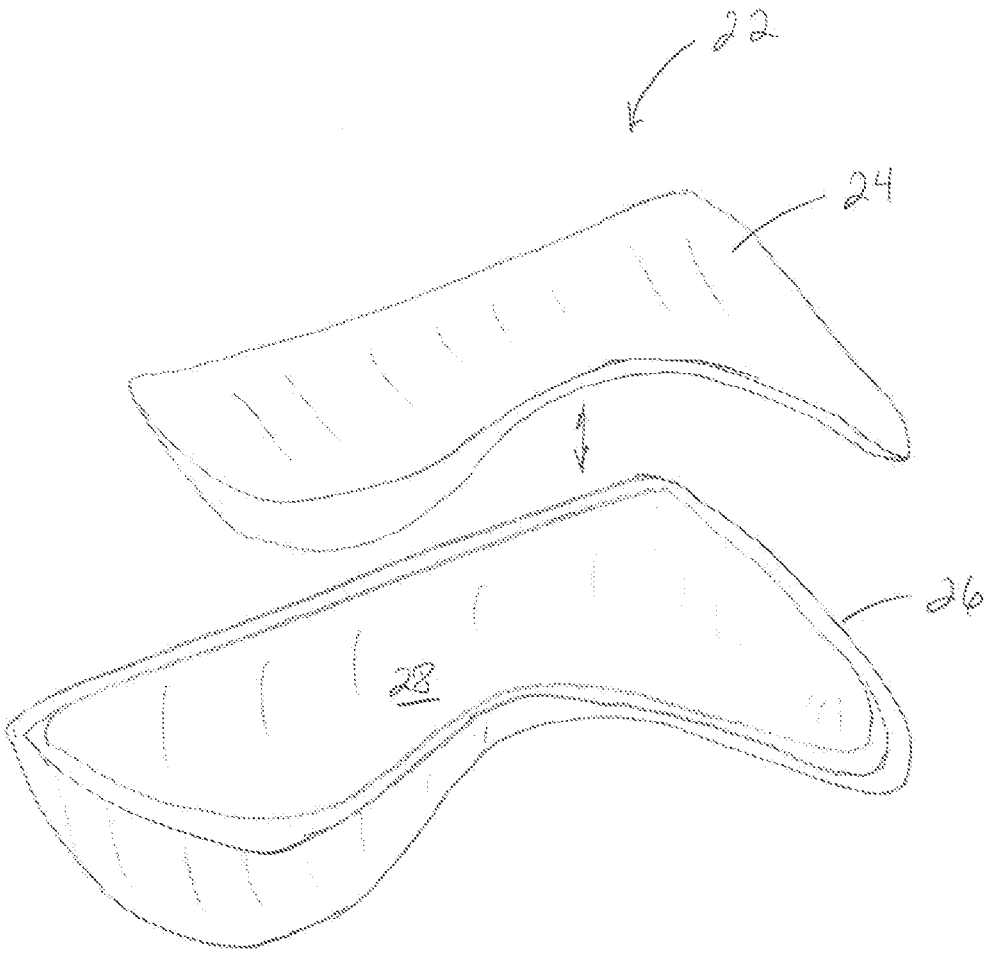
FIG. 2 depicts an exploded view of a composite pad for a saddle panel according to the present disclosure.
Figure 3:
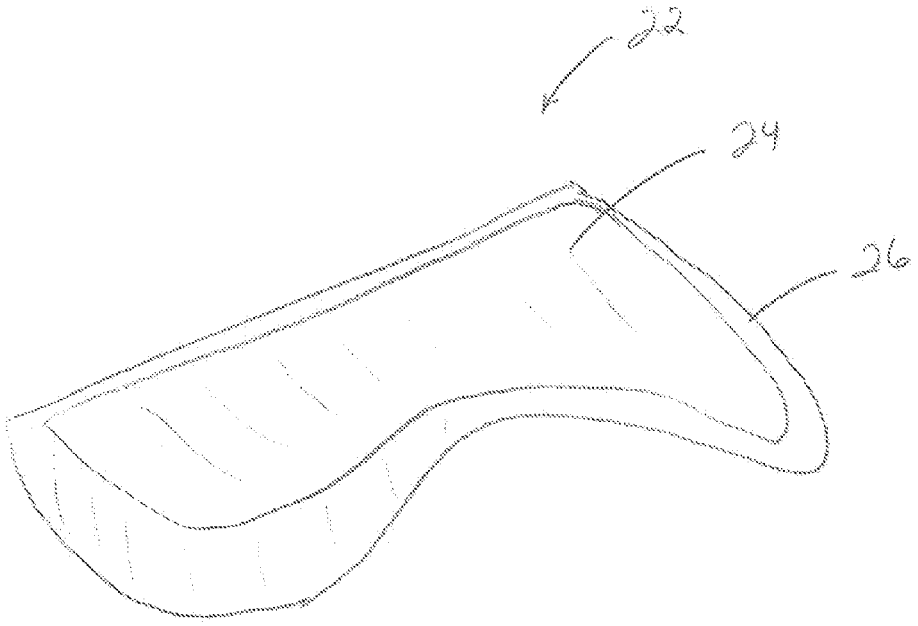
FIG. 3 depicts the assembled composite pad of FIG. 2.
Figure 4:
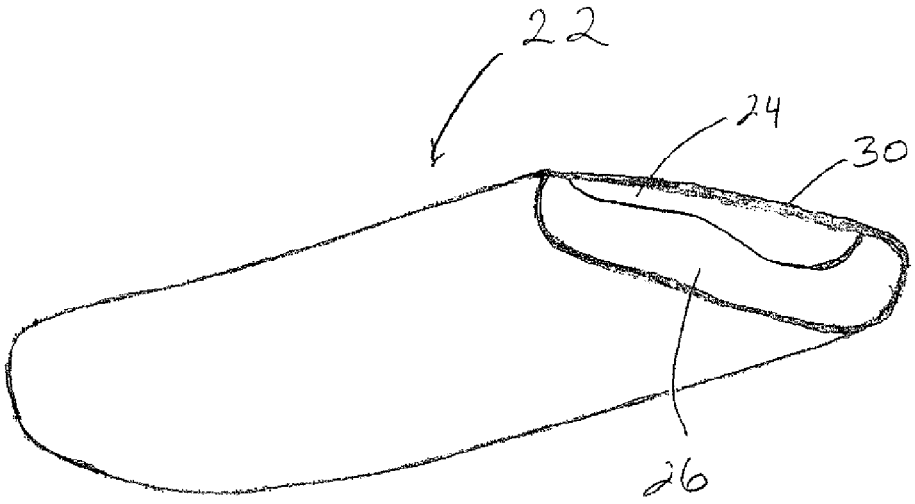
FIG. 4 depicts the assembled composite pad of FIG. 2 in partial cross-section, including a covering of saddle material.

In one aspect (see FIG. 2) a composite pad 22 is provided including a first panel 24 and a second panel 26. The second panel 26 includes a cavity or recess 28 defined therein, configured to snugly receive the first panel 24 therein as shown in FIG. 3. The first and second panels 24, 26 may be held together by an exterior layer 30 (see FIG. 4) of saddle-making material, which as is known may be leather, a synthetic material, or combinations thereof. When assembled (see FIG. 3), the exterior surface of the first panel 24 is substantially coplanar with an outer margin defined by the exterior dimension of the second panel 26, and so the exterior dimension or margin of the assembled composite pad 22 is substantially identical to the exterior margin of the second panel 26. In this manner, a composite pad 22 is provided having varying degrees of firmness without increasing a thickness or diameter thereof.

Figure 6:
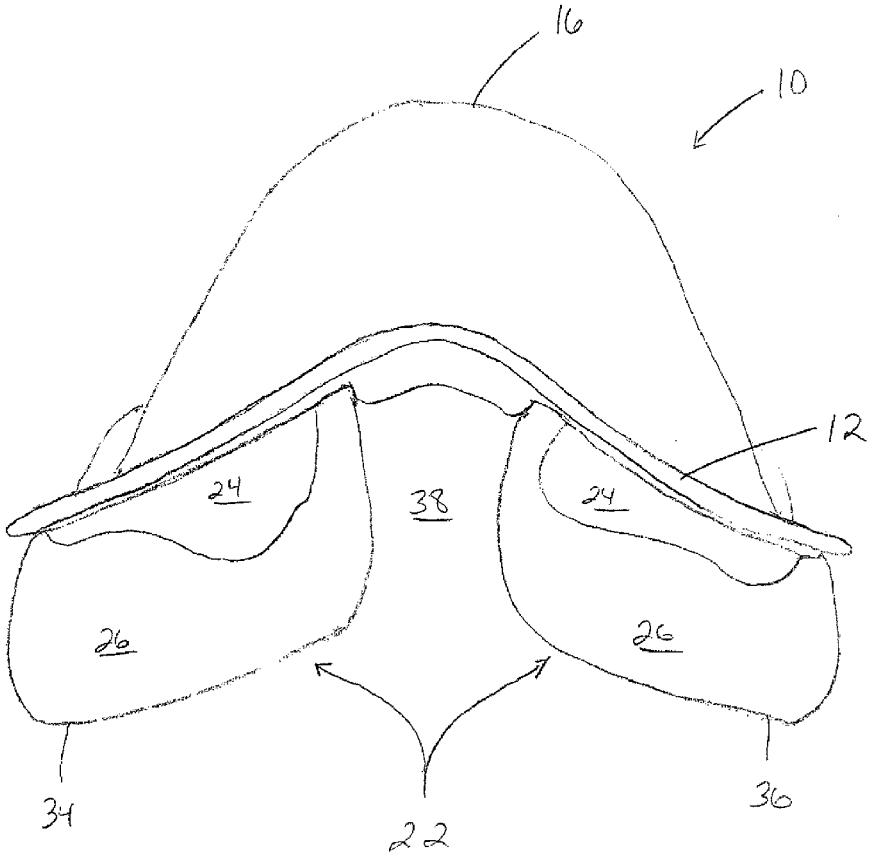
FIG. 6 depicts an end cross-sectional view of a saddle incorporating the composite pad for a saddle panel of the present disclosure.

The first and second panels 24, 26 are oriented such that the second panel 26 underlies the first panel 24 when the composite pad 22 is secured to a saddle. First and second panels 24, 26 are provided having differing degrees of firmness. Typically, a second panel 26 (which in the above-described configuration will be closest to the back of a horse wearing the saddle 10, see FIG. 6) will be provided having a firmness that is less than the firmness of the first panel 24.

It will be appreciated that the first and second panels 24, 26 may be fabricated of any suitable material or combination of materials as are known in the art of saddle-making, including without intending any limitation natural or synthetic materials such as cotton, wool, fleece, polyesters, foam, foam rubber, ethylene vinyl acetate (EVA) foam, closed-cell foams, open-cell foams, other synthetic fabrics, rubber, gels, silicone gels, or other suitable natural or synthetic shock-absorbing and/or cushioning materials or combinations thereof.

Figure 5:
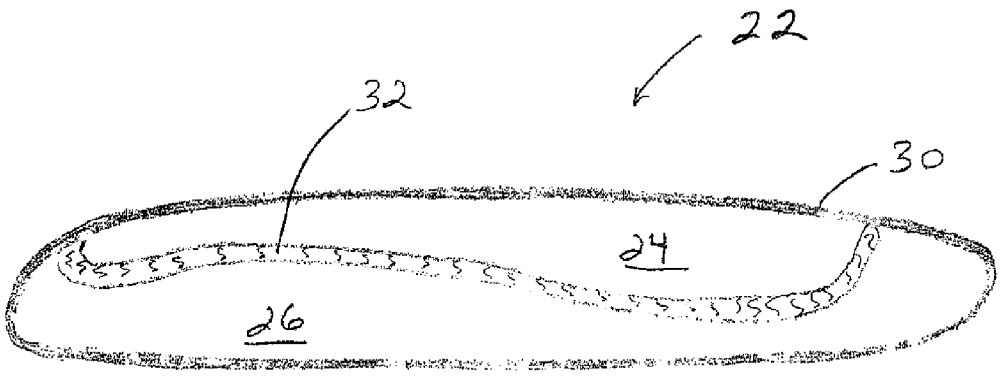
FIG. 5 depicts an end cross-sectional view of one embodiment of an assembled composite pad for a saddle panel according to the present disclosure, including an intervening layer of breathable material.

In an embodiment, a layer 32 comprising a breathable material may be disposed between at least a portion of the first and second panels 24, 26 (see FIG. 5). Any suitable breathable material is contemplated having a structure whereby moisture, vapor, heat, etc. may transpire and/or be wicked away from the saddle panel interior. Typically, breathable materials would be selected that would not allow passage of larger particles such as debris, dirt, dust, sand, etc.

In use (see FIG. 6), a saddle panel 20 for a saddle 10 is made using the composite pad 22 as described above. The saddle panel 20 is of substantially conventional configuration, defining adjoining spaced-apart pads 34, 36 with an intervening channel 38 defined therebetween. The saddle panel 20 may be a unitary construction or may include separate pads 34, 36 disposed on or near an underside of the saddle seat 12, spaced apart to define the desired channel 38. In this manner, the softer second panels 26 will provide improved cushioning and comfort for a horse (not shown) wearing the saddle 10. On the other hand, the relatively firmer first panels 24 which is disposed closest to the saddle seat 12 provides a firmer surface for the rider (not shown), improving rider "feel" and "contact" with the saddle during use.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the foregoing description when interpreted in accordance with the breadth to which it is fairly, legally and equitably entitled.

What is claimed is:

1. A saddle comprising:

first and second adjoining composite pads separated by a channel, each adjoining composite pad comprising:

a first composite pad panel fabricated of a material having a first firmness property; and a second composite pad panel adjoining the first composite pad panel and fabricated of a material having a second firmness property that is different from the first firmness property;

wherein the first composite pad panel is fully contained within a cavity defined in the second composite pad panel such that an exterior surface of the first composite pad panel is substantially coplanar with an outer margin of the second composite pad panel, and whereby each of the first and second adjoining composite pads has an exterior dimension substantially the same as an exterior dimension of the second composite pad panel;

an exterior covering of a natural or synthetic material; and a breathable layer disposed between at least a portion of the first composite pad panel and the second composite pad panel, the breathable layer comprising at least one layer of a porous material for allowing passage of moisture or vapor but not particulate debris therethrough.

2. The saddle panel of claim 1, wherein the second firmness property is less than the first firmness property and the first and second composite pad panels are oriented whereby the first composite pad panel is disposed above and nested within the second composite pad panel.

3. A saddle for equitation, comprising:

a saddle panel defined by adjoining pads separated by a channel, each adjoining pad comprising a composite pad having a first panel having a first firmness property and a second panel having a second firmness property that is different than the first firmness property;

an exterior covering of a natural or synthetic material; and a breathable layer disposed between at least a portion of the first and second panels in each composite pad, the breathable layer comprising at least one layer of porous material for allowing passage of moisture or vapor but not particulate debris therethrough;

wherein, in each composite pad, the first panel nests completely within a space defined by a cavity within the second panel and said space is further defined by a plane defined by an outer margin of the second panel, whereby the composite pad is formed such that an exterior surface of the first panel is coplanar with the outer margin of the second panel, and an exterior dimension of the composite pad is substantially the same as an exterior dimension of the second panel;

further wherein, in each composite pad, the first and second panels are configured such that in an assembled saddle, the second panel is disposed below the first panel.

4. The saddle of claim 3, wherein the second firmness property is less than the first firmness property.

* * * * *